US012098908B2

(12) United States Patent
Davis et al.

(10) Patent No.: US 12,098,908 B2
(45) Date of Patent: Sep. 24, 2024

(54) AMMUNITION BUCKET

(71) Applicant: Gel Blaster LLC, Austin, TX (US)

(72) Inventors: Eric Alan Davis, Austin, TX (US); Robert Kovacs, Budapest (HU); Colin Guinn, Austin, TX (US)

(73) Assignee: Gel Blaster LLC

( * ) Notice: Subject to any disclaimer, the term of this patent is extended or adjusted under 35 U.S.C. 154(b) by 0 days.

(21) Appl. No.: 17/994,346

(22) Filed: Nov. 27, 2022

(65) Prior Publication Data

US 2023/0324157 A1 Oct. 12, 2023

Related U.S. Application Data

(63) Continuation-in-part of application No. 17/714,367, filed on Apr. 6, 2022, now Pat. No. 11,512,937.

(51) Int. Cl.
*F42B 39/26* (2006.01)
*F42B 6/00* (2006.01)
*F42B 39/00* (2006.01)

(52) U.S. Cl.
CPC ..... *F42B 39/002* (2013.01); *F42B 6/00* (2013.01); *F42B 39/26* (2013.01)

(58) Field of Classification Search
CPC ..... B65D 21/086; F42B 39/26; F42B 6/10; F41A 9/64
See application file for complete search history.

(56) References Cited

U.S. PATENT DOCUMENTS 1,097,690 A 5/1914 Ward
4,193,518 A * 3/1980 Holmes ..... A45F 3/20 222/464.2
5,232,120 A 8/1993 Durken et al.
5,653,881 A 8/1997 Bruss et al.
10,730,693 B1 8/2020 Ernsberger
2004/0079755 A1 4/2004 Graus
2006/0163251 A1 7/2006 Kelstrom et al.
2012/0205371 A1 8/2012 Lee
2015/0253055 A1 9/2015 Tsui
2018/0118410 A1 5/2018 Wood et al.

FOREIGN PATENT DOCUMENTS

GB 2538290 A * 11/2016 ..... B65D 21/086
WO 2017052475 A1 3/2017

OTHER PUBLICATIONS

International Search Report and Written Opinion (Apr. 27, 2023).
International Search Report and Written Opinion, PCT/US23/81065 (Apr. 18, 2024).
"Gel Blaster Collapsible Ammo Tub," Amazon.com, Jan. 13, 2022.

* cited by examiner

*Primary Examiner* — Jonathan C Weber
(74) *Attorney, Agent, or Firm* — Kirby Drake

(57) ABSTRACT

An ammunition bucket may be provided for preparation of ammunition for toy blasters having greater ease of use with less mess. The bucket may be collapsible having sides that collapse in an accordion style, and the bucket may include a carrying handle. The lid may be sealed and resistant to splashing and leakage. A lower recessed port area may be provided at the lowest portion of the bucket body. This port may be a three-way drain and strain port. The lower recessed port area may include a dispensing valve with a primary control notch and a flap that provides rate control for the valve. The dispensing valve also may include a secondary control notch that limits an opening of the dispensing valve to prevent ammunition from leaving the bucket.

13 Claims, 19 Drawing Sheets

AMMUNITION BUCKET

CROSS-REFERENCE TO RELATED APPLICATION

The present application is a continuation-in-part of U.S. patent application Ser. No. 17/714,367 filed Apr. 6, 2022, the disclosure of which is incorporated by reference in its entirety.

FIELD OF THE DISCLOSURE

The present disclosure generally relates to an ammunition bucket for a blaster, and more particularly, a Gellet bucket for a blaster.

BACKGROUND

Ammunition buckets for preparation of ammunition such as Gellets or water-based beads for use in blasters have been provided. However, when used for preparation of this ammunition, it can be messy and somewhat hard to use particularly when straining excess water. In addition, there can be some challenges with the portability of the ammunition buckets especially when they are filled with ammunition and water.

SUMMARY

Embodiments of the present disclosure may provide an ammunition bucket for preparation of ammunition for blasters having greater ease of use with less mess. The bucket may be collapsible having sides that collapse in an accordion style, and the bucket may include a carrying handle. The lid may be sealed and resistant to splashing and leakage. The lid may snap onto the bucket body but may be easily removable. The lid may form a good seal to limit splash or disconnection; however, the lid may include a small, tethered vent to disallow vacuum formation during ammunition pours. A lower recessed port area may be provided at the lowest portion of the bucket body. This port may be a three-way drain and strain port in an embodiment of the present disclosure. The lower recessed port area may include a dispensing valve with a primary control notch and a flap that provides rate control for the valve. When the valve is closed and latched, the bucket may be sealed watertight. When the valve is open with the primary control notch in a first position, water may drain from the bucket but no ammunition leaves the bucket. When the valve is open with the primary control notch in a second position, ammunition may dispense from the bucket. The dispensing valve also may include a secondary control notch that limits an opening of the dispensing valve to prevent ammunition from leaving the bucket.

Embodiments of the present disclosure may provide an ammunition bucket for preparation of ammunition for a blaster comprising: a body that receives ammunition to be prepared and water; a sliding door adjacent to the body, the sliding door having a plurality of position locks; and a port having a downward slope relative to the body, wherein when the sliding door is in a first position lock, no water or ammunition exits the port, when the sliding door is in a second position lock above the first position lock, water but no ammunition exits the port, and when the sliding door is in a third position lock above the second position lock, water and ammunition exits the port. The port may be a three-way drain and strain port. The port may be a dispensing valve with a primary control notch and a flap that provides rate control for the valve. When the port is in the first position lock, the ammunition bucket is sealed watertight. The dispensing valve may include a secondary control notch that limits an opening of the dispensing valve to prevent ammunition from leaving the bucket in the first position lock and the second position lock. The body may have sides that collapse in an accordion style when not in use.

Further embodiments of the present disclosure may provide an ammunition container for preparation of ammunition for a blaster comprising: a body that receives ammunition to be prepared and water; a port integral with the body that provides an exit for ammunition and/or water; and a removable lid that snaps onto a top portion of the body, wherein the removable lid forms a seal with a top portion of the body to limit splash or disconnection, the removable lid rotatable to three positions, wherein the removable lid is in a first position, no water or ammunition exits the port, when the removable lid is in a second position, water but no ammunition exits the port, and when the removable lid is in a third position, water and ammunition exits the port. The ammunition container also may include a handle integrally formed with the body. The port may be a three-way drain and strain port. The port may be a dispensing valve with a primary control notch and a flap that provides rate control for the valve. When the port is in the first position, the ammunition container is sealed watertight. The dispensing valve may include a secondary control notch that limits an opening of the dispensing valve to prevent ammunition from leaving the container in the first position and the second position. The ammunition container also may include a small, tethered vent on the lid to disallow vacuum formation during ammunition pours.

BRIEF DESCRIPTION OF THE DRAWINGS

For a more complete understanding of this disclosure, reference is now made to the following description, taken in conjunction with the accompanying drawings, in which.

DETAILED DESCRIPTION

Embodiments of the present disclosure may provide an ammunition bucket for preparation of ammunition for blasters having greater ease of use with less mess. The ammunition bucket may be more functional as well as provide easier portability. It should be appreciated that the ammunition bucket may be used for preparation of Gellets™ in an embodiment of the present disclosure. As described herein, Gellets™ are colorful, water-based beads that are formed of a water-based material that may be utilized with a toy blaster to burst on impact and evaporate in 30 minutes or less. However, other ammunition may be utilized in the ammunition bucket without departing from the present disclosure.

Figure 1:
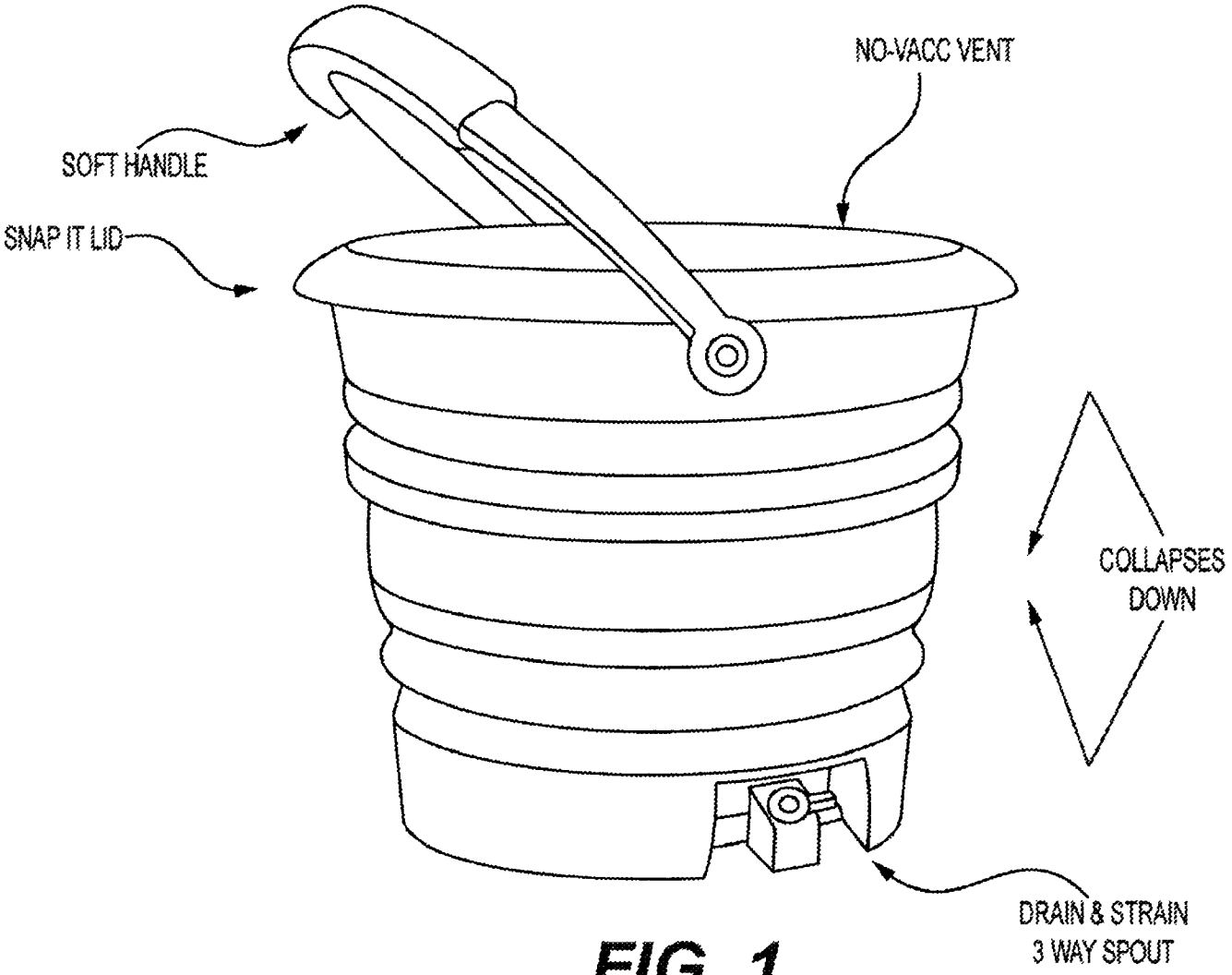
FIG. 1 depicts an ammunition bucket according to an embodiment of the present disclosure.

FIG. 1 depicts an ammunition bucket according to an embodiment of the present disclosure. The bucket may retain the same or greater volume while collapsing into the same or small form factor of the existing product. The bucket may include a carrying handle, similar or with greater ergonomics consideration for the user. The bucket can be very heavy when full, so the addition of a hook and loop-removable cushion may add comfort in embodiments of the present disclosure. The lid may be sealed and resistant to splashing and leakage. The lid may be formed of a semi-flexible plastic in an embodiment of the present disclosure; however, other materials may be used without departing from the present disclosure. The lid may snap onto the bucket body but may be easily removable. The lid may form a good seal to limit splash or disconnection; however, the lid may include a small, tethered vent to disallow vacuum formation during ammunition pours. The sides of the bucket body may collapse in an accordion style. A lower recessed port area may be provided at the lowest portion of the bucket body. This port may be a three-way drain and strain port in an embodiment of the present disclosure.

Figure 2:
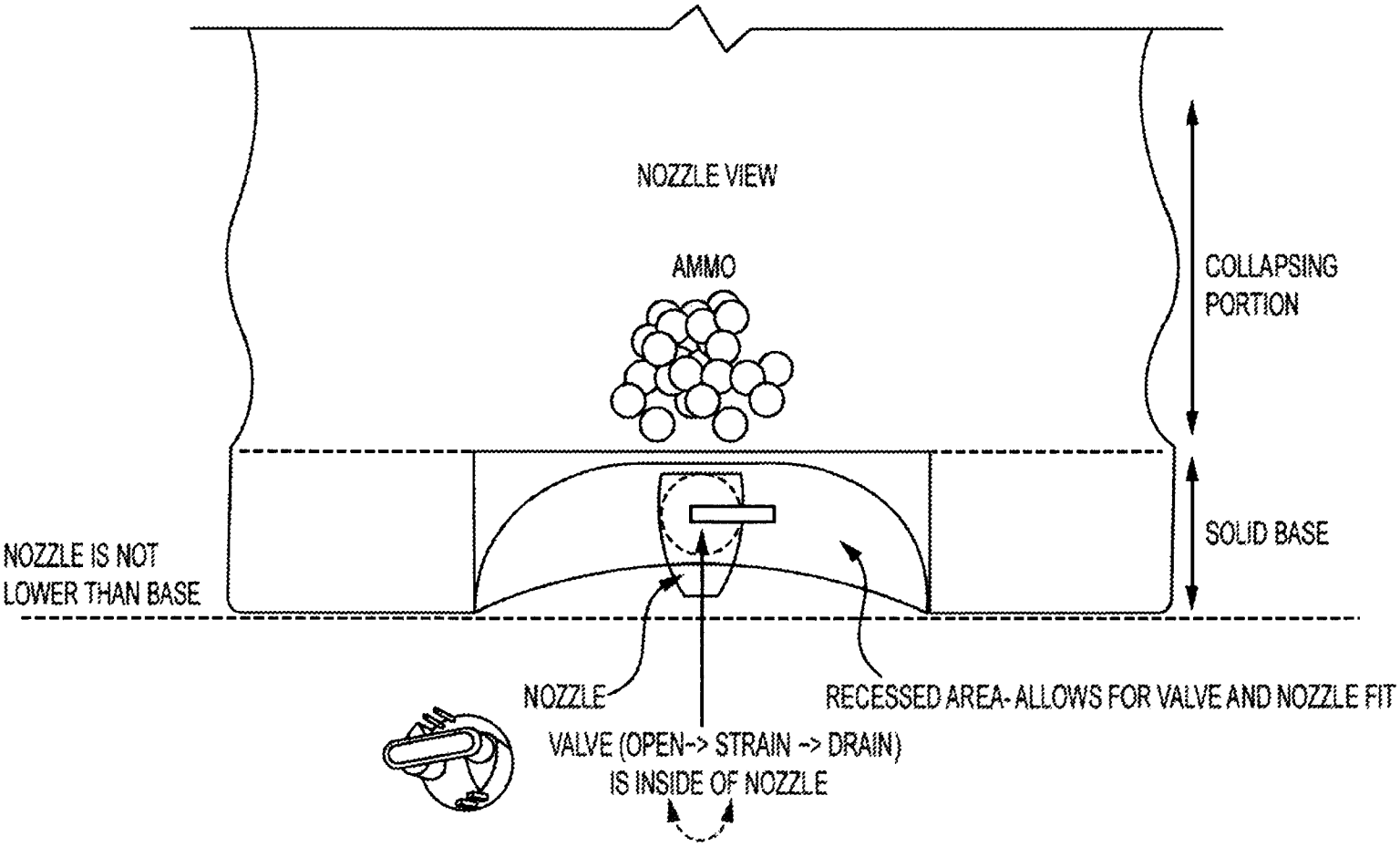
FIG. 2 depicts a nozzle view of an ammunition bucket according to an embodiment of the present disclosure.

FIG. 2 depicts a nozzle view of an ammunition bucket according to an embodiment of the present disclosure. As depicted herein, the sides of the bucket body may be collapsible with a solid base that may include a recessed area allowing for a valve and nozzle fit. There may be a valve inside of the nozzle that may be open to drain and strain in an embodiment of the present disclosure. It should be appreciated that the nozzle may not be lower than the solid base.

Figure 3A:
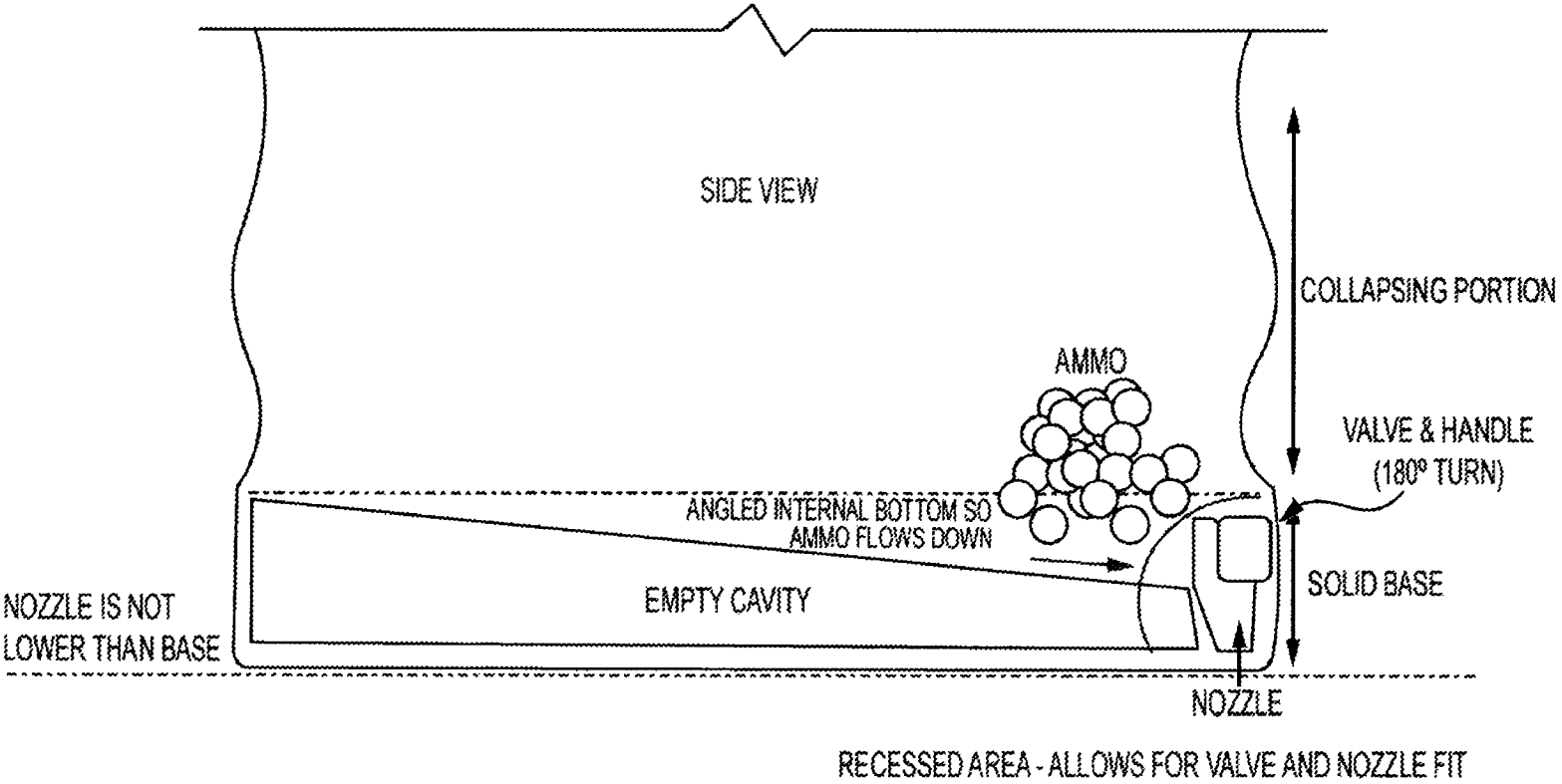
FIG. 3A depicts a side view of an ammunition bucket according to an embodiment of the present disclosure.
Figure 3B:
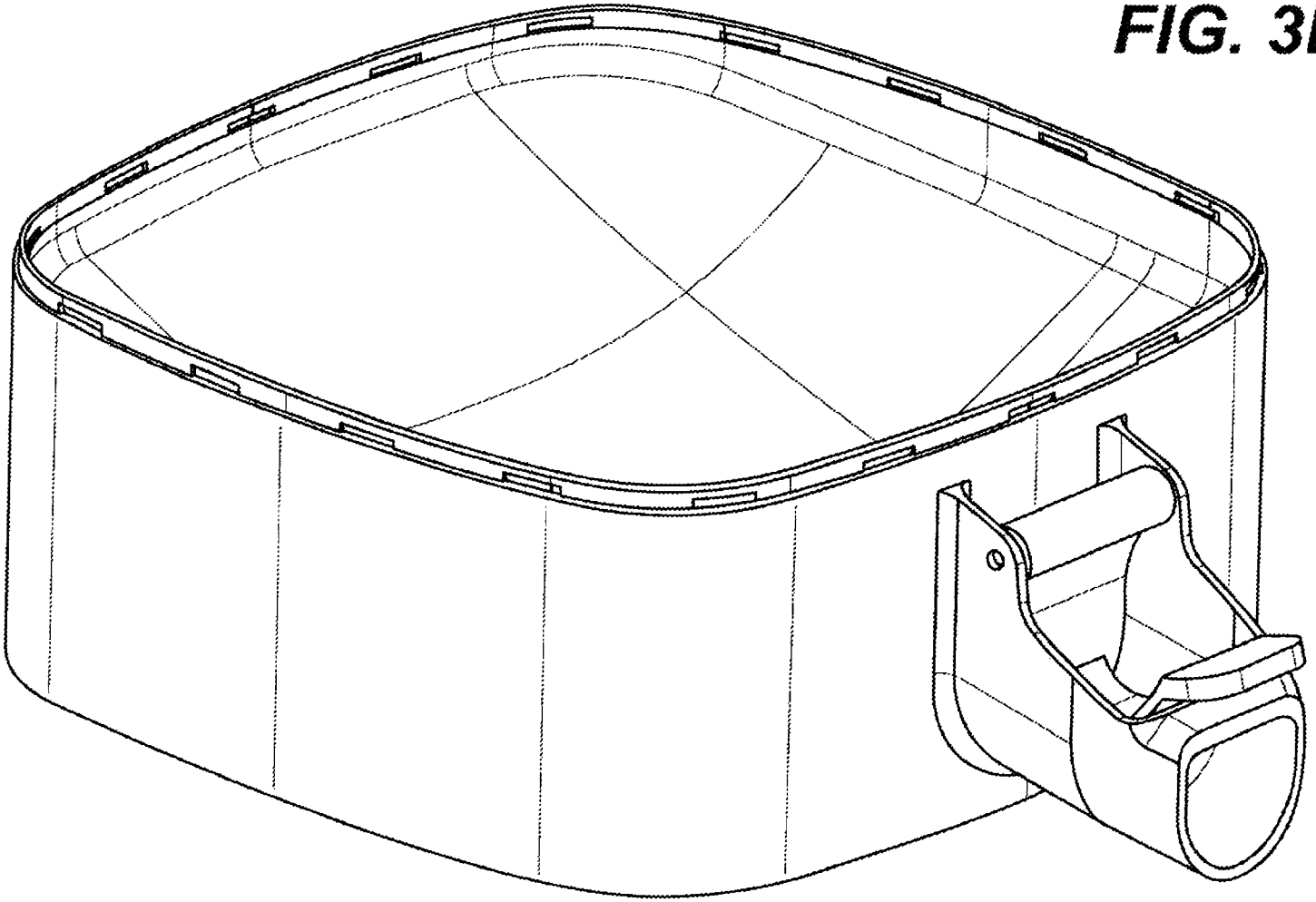
FIG. 3B depicts a solid base of an ammunition bucket according to an embodiment of the present disclosure.

FIG. 3A depicts a side view of an ammunition bucket according to an embodiment of the present disclosure. As depicted in FIGS. 3A and 3B, the inner area of the solid base may be convex or tilted to the lower spout in the recessed area. This may provide an angled internal bottom so that ammunition may flow down toward the nozzle. In an embodiment of the present disclosure, the valve and handle may provide a 180-degree turn. It should be appreciated that the lower recessed port area should not protrude lower than the solid base of the bucket. It also should not be exposed greater than the diameter perimeter of the bucket to avoid damage or opening of the valve.

Figures 4A, 4B, 4C:
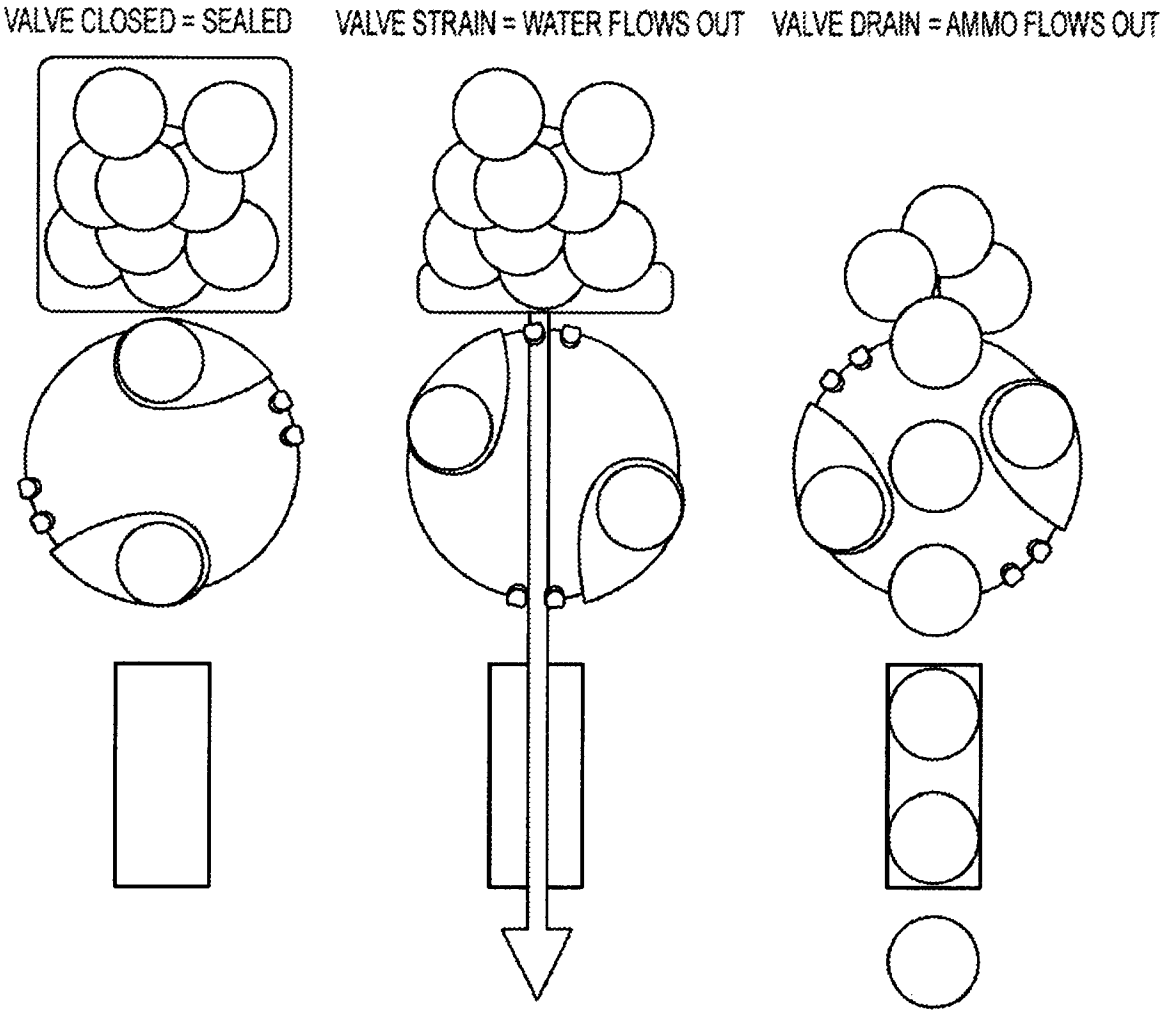
FIGS. 4A-4C depict configurations of a bidirectional twist lock on a valve of an ammunition bucket according to an embodiment of the present disclosure.

FIGS. 4A-4C depict configurations of a bidirectional twist lock on a valve of an ammunition bucket according to an embodiment of the present disclosure. As depicted herein, FIG. 4A depicts when the valve is closed or sealed, FIG. 4B depicts a valve strain configuration when water flows out, and FIG. 4C depicts a valve drain configuration when ammunition flows out. When the valve selector is moved to the left (FIG. 4A), the valve is closed and no water or ammunition may escape the bucket. When the valve selector is in the middle (FIG. 4B), the valve is open to strain. Water may be allowed to escape the bucket, but the ammunition may stay trapped. A screen may be used inside the valve to block the ammunition without damaging the Gellets, while also allowing sufficient water to pass through and empty. When the valve selector is moved to the right (FIG. 4C), the valve is open to filling. Ammunition is allowed to escape the bucket to fill ammunition canisters and hoppers. It should be appreciated that the valve nozzle may have a diameter narrower than 24 mm so that common ammunition canisters may easily be filled without spillage.

Figure 6:
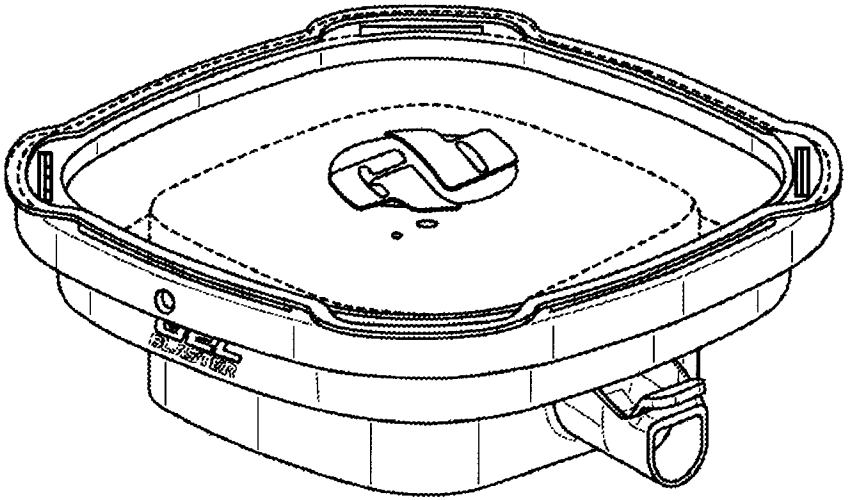
FIG. 6 depicts an ammunition bucket in a collapsed position according to an embodiment of the present disclosure.
Figure 5:
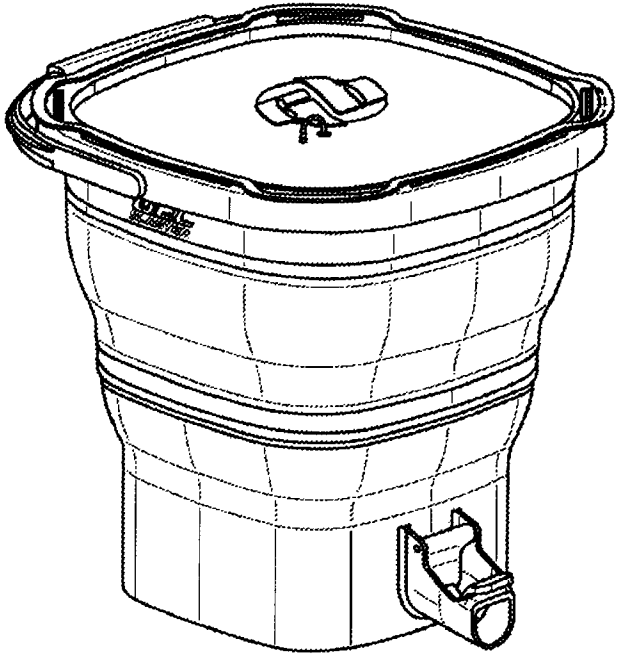
FIG. 5 depicts a front view of an ammunition bucket according to an embodiment of the present disclosure.
Figure 11:
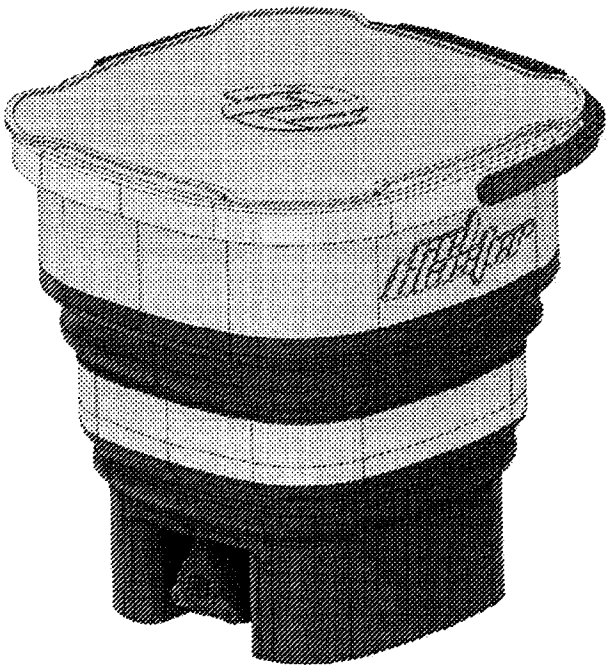
FIG. 11 depicts a front view of an ammunition bucket according to an embodiment of the present disclosure.
Figure 10:
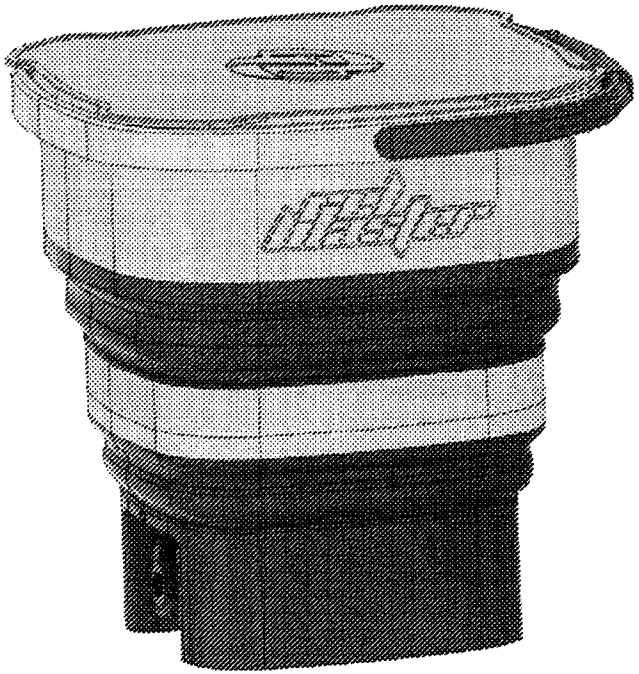
FIG. 10 depicts a side view of an ammunition bucket according to an embodiment of the present disclosure.

FIG. 5 depicts a front view of an ammunition bucket according to an embodiment of the present disclosure. As depicted herein, the bucket may include a carrying handle that may include padding in an embodiment of the present disclosure. The bucket may include a semi-flexible plastic vacuum valve in some embodiments of the present disclosure. FIG. 11 depicts another front view of an ammunition bucket according to an embodiment of the present disclosure, and FIG. 10 depicts a side view of an ammunition bucket according to an embodiment of the present disclosure. FIG. 6 depicts an ammunition bucket in a collapsed position according to an embodiment of the present disclosure. The bucket may retain an internal volume of 1.1 gallons, holding approximately 12,000 Gellets. The sides may collapse "accordion" style as depicted in FIG. 6, with a lower nozzle area at the lowest portion of the base. The collapsed form of the bucket may fit into a box that is 230×75×235 mm in an embodiment of the present disclosure. This may maximize units per container for shipping.

Figure 7A:
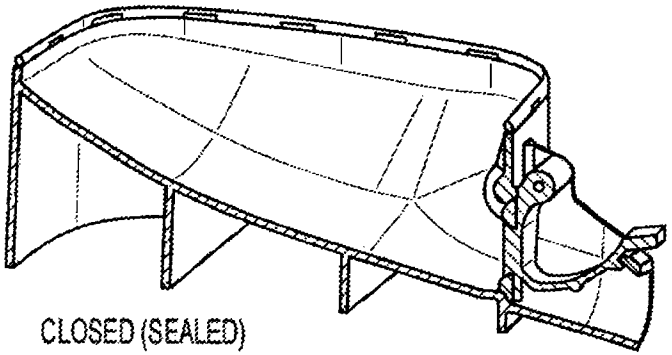
FIGS. 7A-7C depict positions of a locking flap of a dispensing valve according to an embodiment of the present disclosure.
Figure 7B:
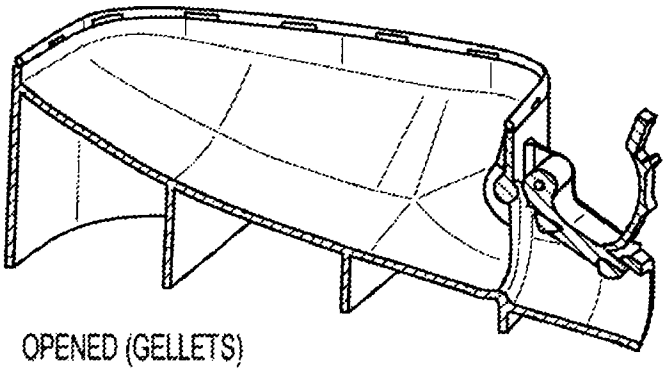
Figure 7C:
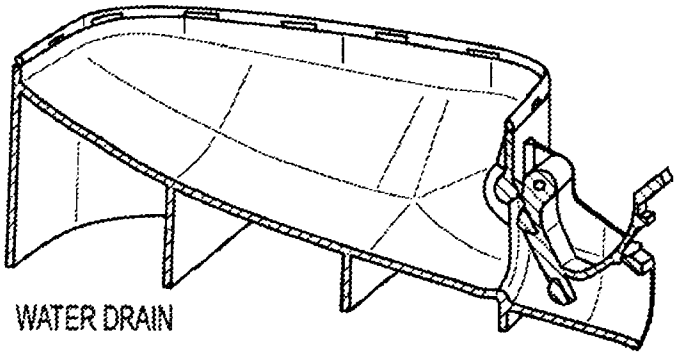

FIGS. 7A-7C depict positions of a locking flap of a dispensing valve according to an embodiment of the present disclosure. When the valve is closed and latched (FIG. 7A), the bucket may be sealed watertight. A primary control notch may ensure that the seal has sufficient force to keep the system watertight. Lifting of a finger-hold may release the primary control notch. When the valve is open in a first position (FIG. 7B), water may be allowed to drain, with no Gellet ammunition escaping. A secondary control notch may limit the opening to less than 6.8 mm gate, preventing Gellets from dispensing. The secondary control notch may serve as an indicator for proper hydration of Gellets. If ammunition is dispensing at the first notch, Gellets are not properly hydrated. When the control notch is left open in the first position, all water will drain when left open and no user input is needed if left open. When the valve is open in a second position (FIG. 7C), Gellets are allowed to escape and freely dispense into a hopper at the front of the valve. The valve can be rate controlled by lifting or lowering the flap. An additional control notch may be used to set the final open position.

Figure 8:
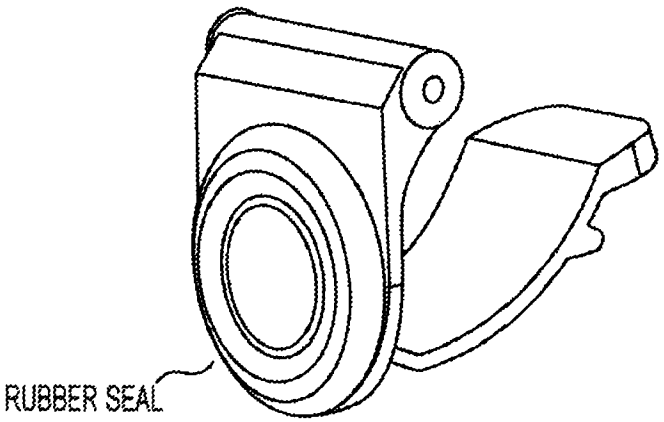
FIG. 8 depicts a valve seal according to an embodiment of the present disclosure.

FIG. 8 depicts a valve seal according to an embodiment of the present disclosure. The shape of the valve seal may disallow Gellet damage, instead forcing any remaining Gellets back into the bucket reservoir instead of being crushed.

Figure 9:
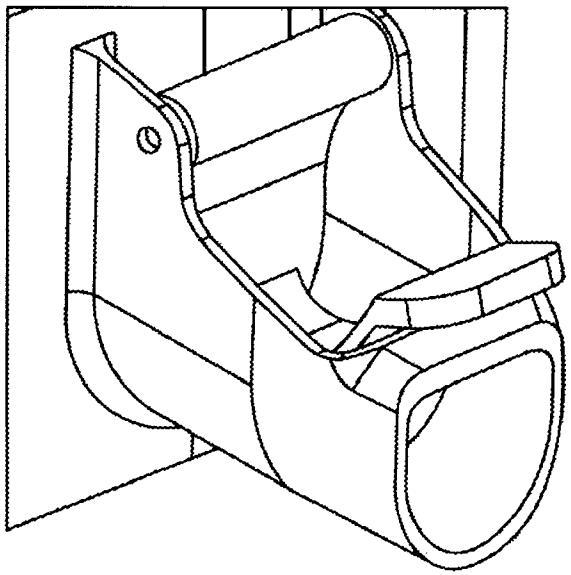
FIG. 9 depicts a valve nozzle according to an embodiment of the present disclosure.

FIG. 9 depicts a valve nozzle according to an embodiment of the present disclosure. The valve nozzle may be at a set diameter and shape so that more common ammunition canisters may be filled without damage.

Figures 12A, 12B, 12C:
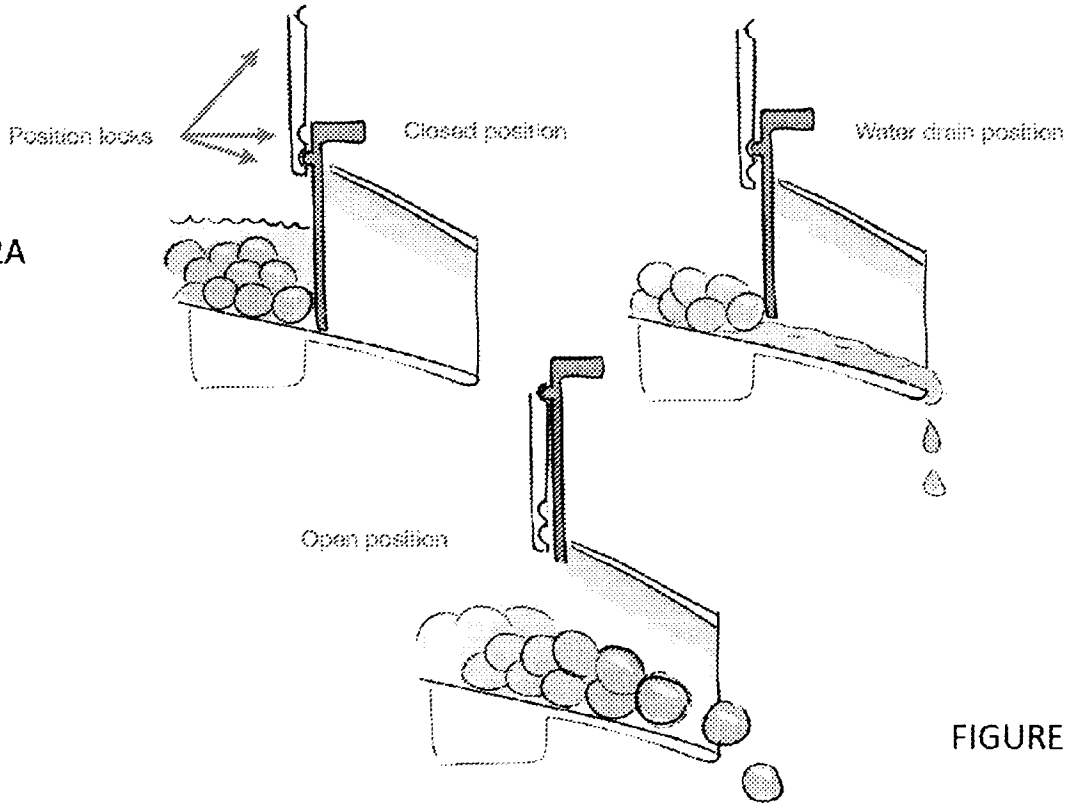
FIGS. 12A-12C depict a sliding door configuration of an ammunition bucket according to an embodiment of the present disclosure.

FIGS. 12A-12C depict a sliding door configuration of an ammunition bucket according to an embodiment of the present disclosure. More specifically, FIG. 12A depicts a closed position having a plurality of position locks wherein the sliding door is in a first position, and no water or ammunition may be released through the sliding door. FIG. 12B depicts a water drain position wherein the sliding door is in a second position above the first position so that water may drain through but the ammunition does not go through the sliding door. FIG. 12C depicts an open position wherein the sliding door is in a third position in the top position lock so that the ammunition may proceed through (i.e., the sliding door does not impede movement of the ammunition). While three position locks are depicted in FIGS. 12A-12C, it should be appreciated that more or fewer position locks may be provided without departing from the present disclosure.

Figure 13B:
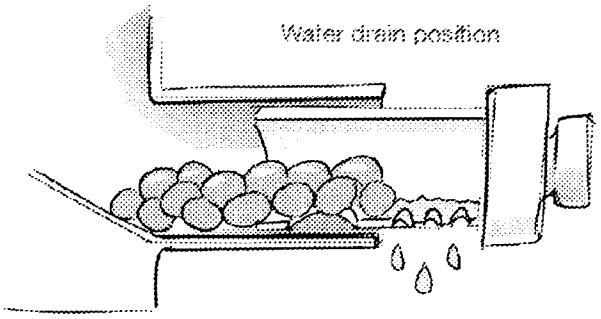
FIGS. 13A-13C depict a sliding plug configuration of an ammunition bucket according to an embodiment of the present disclosure.
Figure 13A:
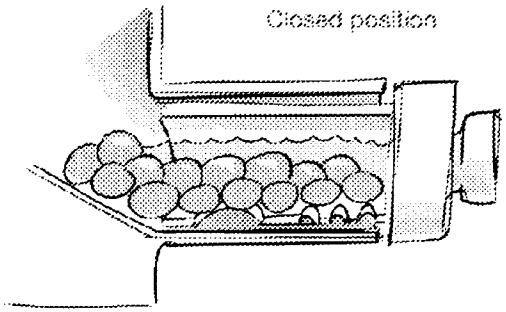
Figure 13C:
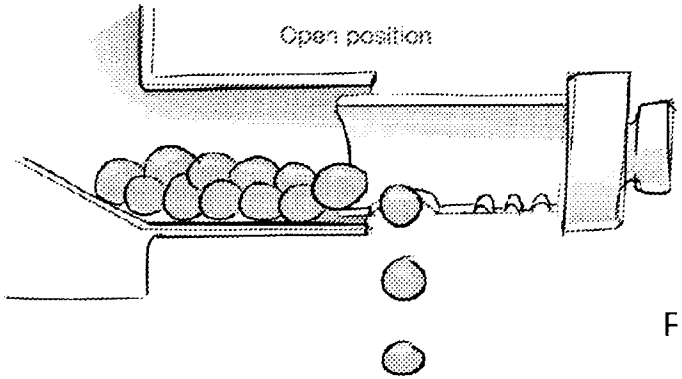

FIGS. 13A-13C depict a sliding plug configuration of an ammunition bucket according to an embodiment of the present disclosure. More specifically, FIG. 13A depicts a closed position wherein the sliding plug is in a closed position and no water or ammunition moves through the sliding plug. FIG. 13B depicts a water drain position wherein the sliding plug is in a second position extending out from the first position so that water may drain through but the ammunition does not go through the sliding plug. FIG. 13C depicts an open position wherein the sliding plug is in an open position so that the ammunition may proceed through (i.e., the sliding plug does not impede movement of the ammunition). While three positions for the sliding plug are depicted in FIGS. 13A-13C, it should be appreciated that more or fewer positions may be provided without departing from the present disclosure.

Figures 14A, 14B, 14C, 14D:
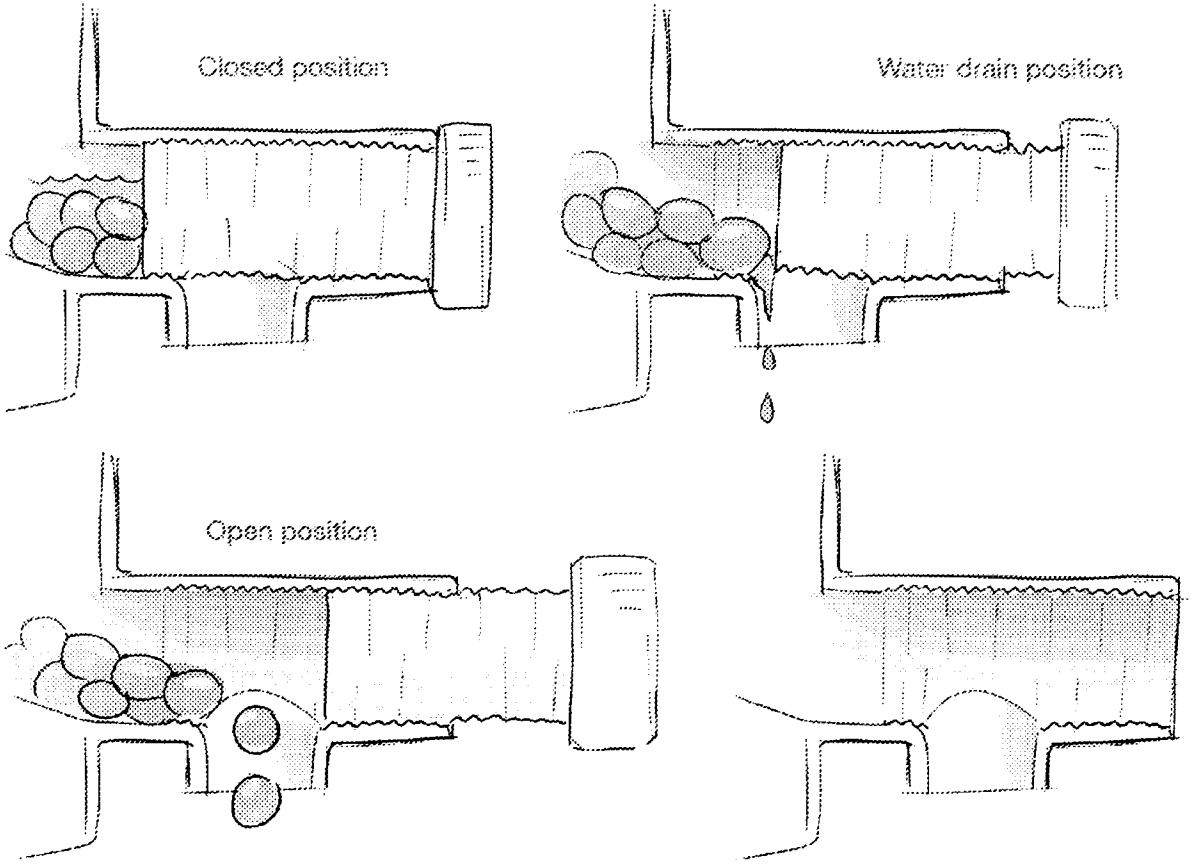
FIGS. 14A-14D depict a threaded plug configuration of an ammunition bucket according to an embodiment of the present disclosure.

FIGS. 14A-14D depict a threaded plug configuration of an ammunition bucket according to an embodiment of the present disclosure. More specifically, FIG. 14A depicts a closed position wherein the threaded plug is in a first position and no water or ammunition leaves through the threaded plug. FIG. 14B depicts a water drain position wherein the threaded plug is in a second position above the first position so that water may drain through but the ammunition does not go through the threaded plug. FIG. 14C depicts an open position wherein the threaded plug is in a third position so that the ammunition may proceed through (i.e., the threaded plug does not impede movement of the ammunition). While three positions for the threaded plug depicted in FIGS. 14A-14C, it should be appreciated that more or fewer positions may be provided without departing from the present disclosure. FIG. 14D depicts a drain for receiving the threaded plug according to an embodiment of the present disclosure.

Figures 15A, 15B, 15C:
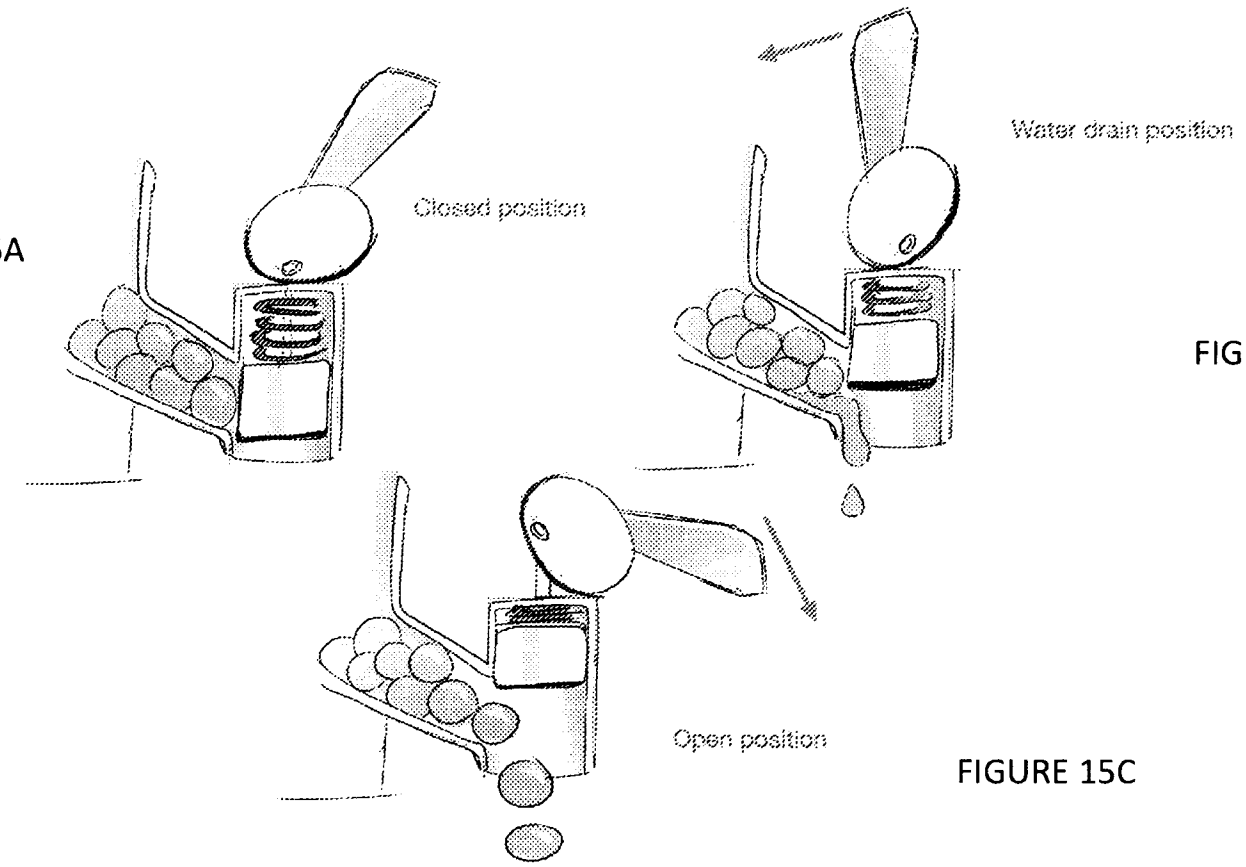
FIGS. 15A-15C depict another sliding plug configuration of an ammunition bucket according to an embodiment of the present disclosure.

FIGS. 15A-15C depict another sliding plug configuration of an ammunition bucket according to an embodiment of the present disclosure. More specifically, FIG. 15A depicts a closed position wherein the sliding plug is in a closed position and no water or ammunition leaves through the sliding plug. FIG. 15B depicts a water drain position wherein the sliding plug is in a second position extending out from the first position so that water may drain through but the ammunition does not go through the sliding plug. FIG. 15C depicts an open position wherein the sliding plug is in an open position so that the ammunition may proceed through (i.e., the sliding plug does not impede movement of the ammunition). While three positions for the sliding plug are depicted in FIGS. 15A-15C, it should be appreciated that more or fewer positions may be provided without departing from the present disclosure.

Figures 16A, 16B:
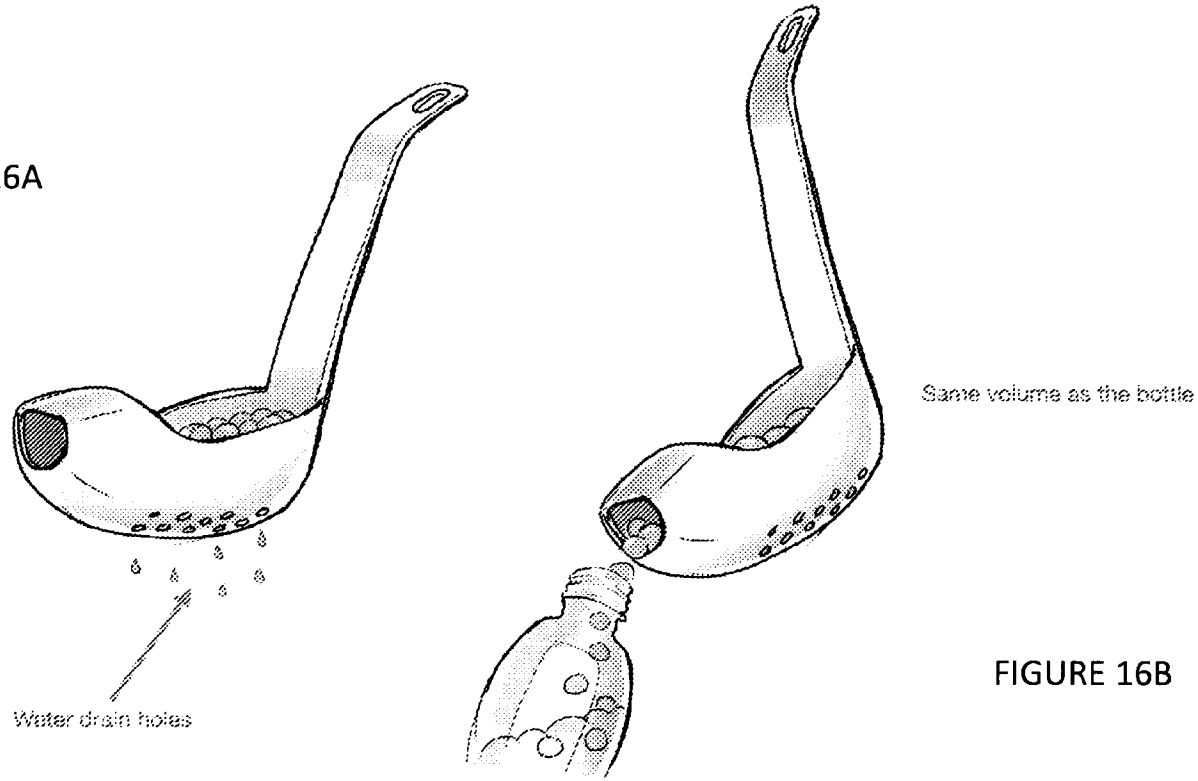
FIGS. 16A-16B depict a ladle configuration of an ammunition bucket according to an embodiment of the present disclosure.

FIGS. 16A-16B depict a ladle configuration of an ammunition bucket according to an embodiment of the present disclosure. More specifically, FIG. 16A depicts water drain holes on a bottom portion of the ladle wherein water may drain while ammunition remains in the ladle, and FIG. 16B depicts a hole in a forward portion of the ladle wherein ammunition may exit the ladle.

Figures 17A, 17B:
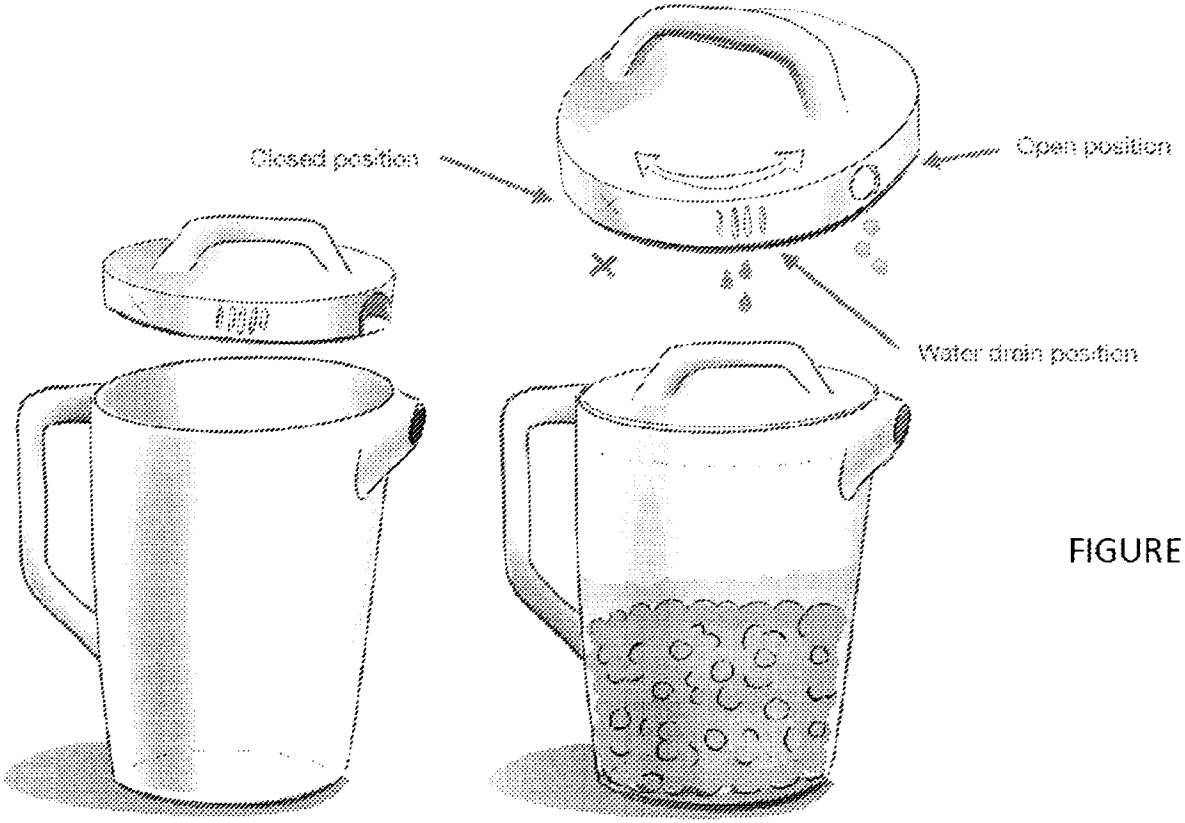
FIGS. 17A-17B depict a pitcher with rotating lid configuration of an ammunition bucket according to an embodiment of the present disclosure.

FIGS. 17A-17B depict a pitcher with rotating lid configuration of an ammunition bucket according to an embodiment of the present disclosure. As depicted herein, FIG. 17A depicts the pitcher with a rotating lid without water or ammunition. FIG. 17B depicts the pitcher with a rotating lid wherein water and ammunition are in the pitcher, and the rotating lid reflects how the lid may be rotated from a closed position (X) to a water draining position to an open position (O) and vice versa. When the rotating lid is in a water draining position, water may exit the pitcher with ammunition remaining in the pitcher; however, when the rotating lid is in an open position, ammunition may exit the pitcher. In an embodiment of the present disclosure, ammunition having a size of approximately 7-8 mm may exit the pitcher. In a closed position, neither water nor ammunition may exit the pitcher.

Figure 18B:
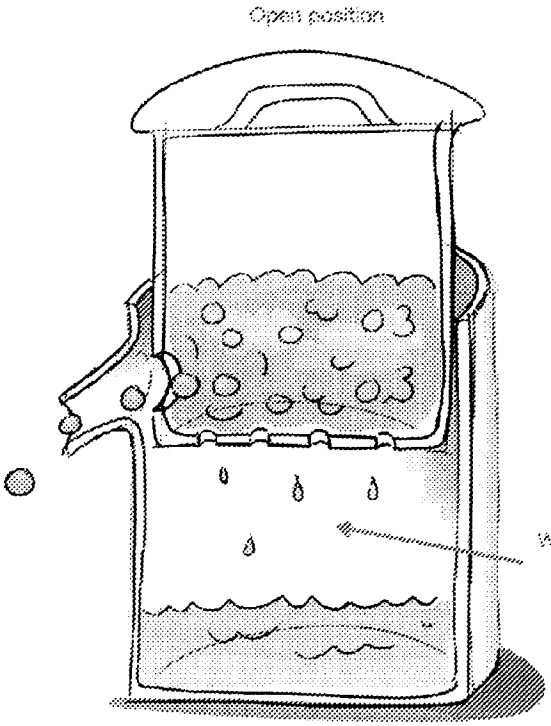
FIGS. 18A-18B depict a bucket with inner container configuration of an ammunition bucket according to an embodiment of the present disclosure.
Figure 18A:
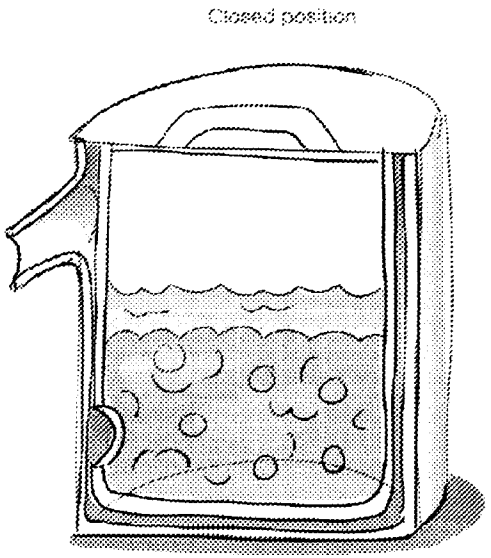

FIGS. 18A-18B depict a bucket with inner container configuration of an ammunition bucket according to an embodiment of the present disclosure. More specifically, FIG. 18A depicts a bucket in a closed position wherein water and ammunition are in an inner container and do not exit the bucket, and FIG. 18B depicts a bucket in an open position where the inner container may be raised so that ammunition may exit the bucket through a spout on a side of the bucket and water drips back into the bucket.

Figures 19A, 19B, 19C, 19D, 19E:
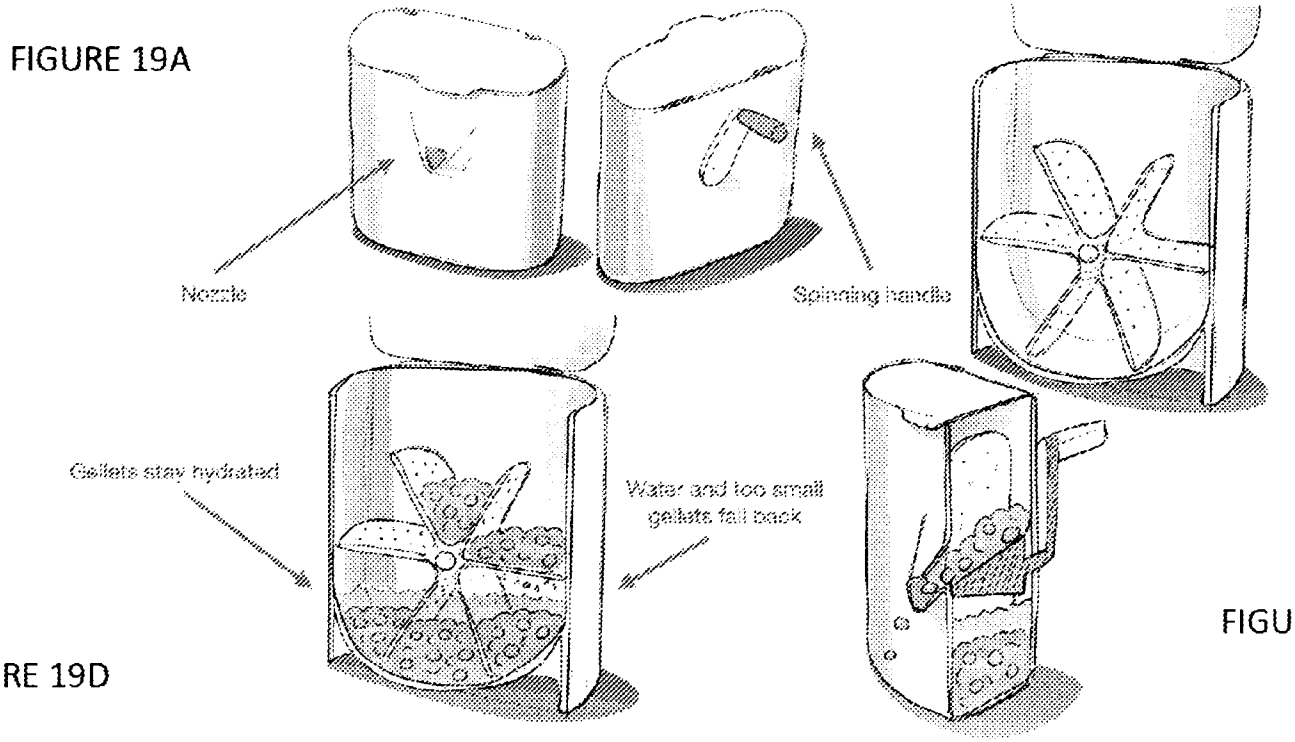
FIGS. 19A-19E depict a water mill configuration of an ammunition bucket according to an embodiment of the present disclosure.

FIGS. 19A-19E depict a water mill configuration of an ammunition bucket according to an embodiment of the present disclosure. FIG. 19A depicts a front view of the water mill having a nozzle, and FIG. 19B depicts a back view of the water mill having a spinning handle. FIG. 19C depicts a cutaway view of the interior of the water mill, and FIG. 19D depicts the cutaway view in FIG. 19C wherein when the water mill turns, the ammunition stays hydrated while water and smaller ammunition fall back. FIG. 19E depicts a side cutaway view of the water mill wherein ammunition leaves the nozzle as the spinning handle turns the water mill.

Figure 20B:
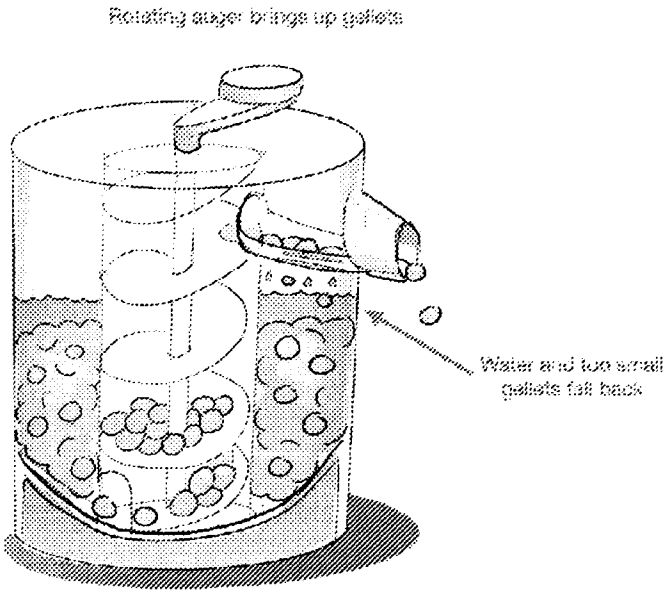
FIGS. 20A-20B depict an auger bucket configuration of an ammunition bucket according to an embodiment of the present disclosure.
Figure 20A:
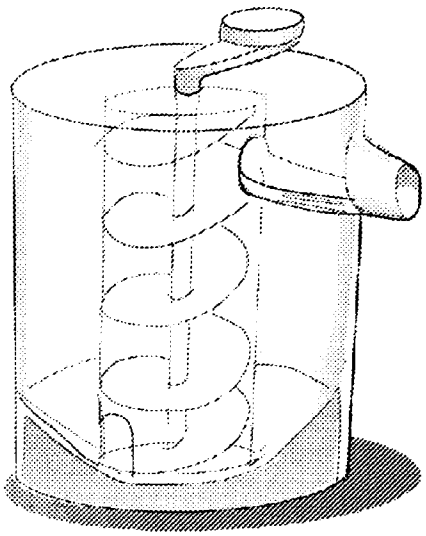

FIGS. 20A-20B depict an auger bucket configuration of an ammunition bucket according to an embodiment of the present disclosure. More specifically, FIG. 20A depicts a view of the auger bucket in an empty configuration having a rotating auger and a nozzle for ammunition to exit the auger bucket. FIG. 20B depicts an auger bucket in use wherein the rotating auger brings up ammunition to exit through the nozzle, and water and smaller ammunition fall back down into the auger bucket.

Figures 21A, 21B:
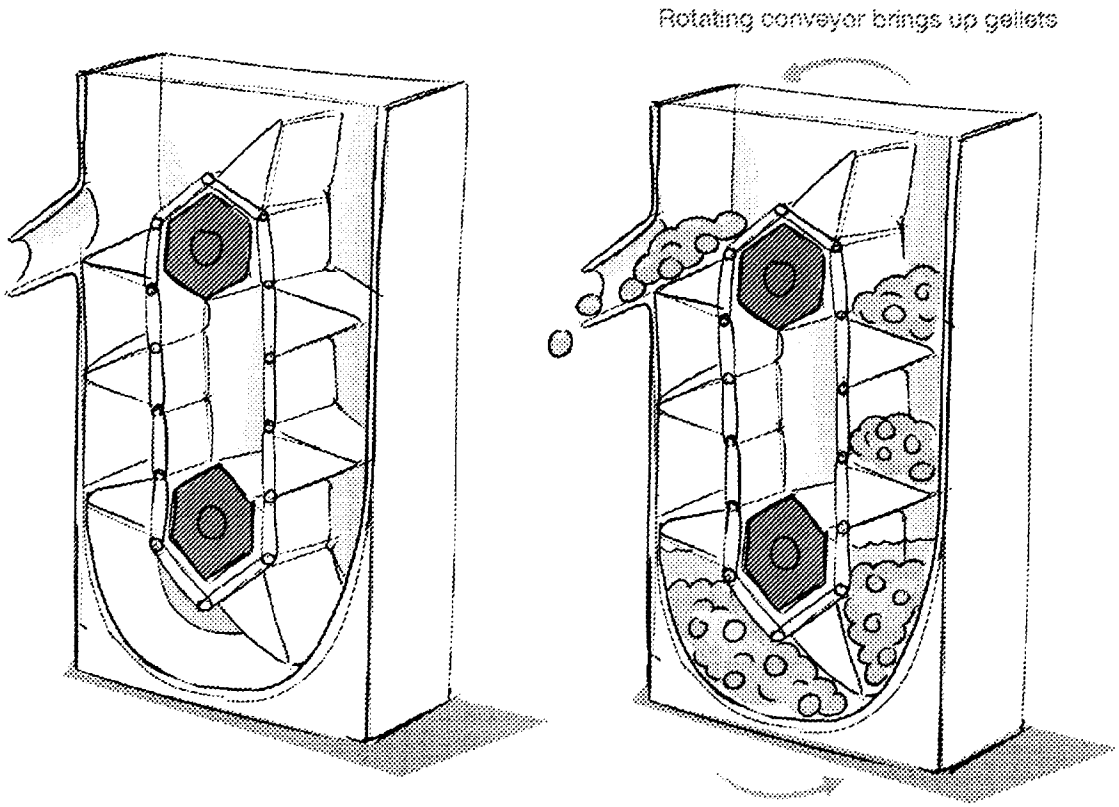
FIGS. 21A-21B depict a conveyor configuration of an ammunition bucket according to an embodiment of the present disclosure.

FIGS. 21A-21B depict a conveyor configuration of an ammunition bucket according to an embodiment of the present disclosure. More specifically, FIG. 21A depicts a view of a conveyor in an empty configuration having a conveyer and a nozzle for ammunition to exit the conveyor. FIG. 21B depicts a conveyor in use wherein the conveyor brings up ammunition to exit through the nozzle, and water and small ammunition fall back down into the bucket.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. An ammunition bucket for preparation of ammunition for a blaster comprising:

a body that receives ammunition to be prepared and water;

a sliding door adjacent to the body, the sliding door having a plurality of position locks; and a port having a downward slope relative to the body, wherein when the sliding door is in a first position lock, no water or ammunition exits the port, when the sliding door is in a second position lock above the first position lock, water but no ammunition exits the port, and when the sliding door is in a third position lock above the second position lock, water and ammunition exits the port.

2. The ammunition bucket of claim 1, wherein the port is a three-way drain and strain port.

3. The ammunition bucket of claim 1, wherein the port is a dispensing valve with a primary control notch and a flap that provides rate control for the valve.

4. The ammunition bucket of claim 3, the dispensing valve further comprising:

a secondary control notch that limits an opening of the dispensing valve to prevent ammunition from leaving the bucket in the first position lock and the second position lock.

5. The ammunition bucket of claim 1, wherein when the port is in the first position lock, the ammunition bucket is sealed watertight.

6. The ammunition bucket of claim 1, wherein the body has sides that collapse in an accordion style when not in use.

7. An ammunition container for preparation of ammunition for a blaster comprising:

a body that receives ammunition to be prepared and water;

a port integral with the body that provides an exit for ammunition and/or water; and a removable lid that snaps onto a top portion of the body, wherein the removable lid forms a seal with a top portion of the body to limit splash or disconnection, the removable lid rotatable to three positions, wherein the removable lid is in a first position, no water or ammunition exits the port, when the removable lid is in a second position, water but no ammunition exits the port, and when the removable lid is in a third position, water and ammunition exits the port.

8. The ammunition container of claim 7 further comprising:

a handle integrally formed with the body.

9. The ammunition container of claim 7, wherein the port is a three-way drain and strain port.

10. The ammunition container of claim 7, wherein the port is a dispensing valve with a primary control notch and a flap that provides rate control for the valve.

11. The ammunition container of claim 10, the dispensing valve further comprising:

a secondary control notch that limits an opening of the dispensing valve to prevent ammunition from leaving the container in the first position and the second position.

12. The ammunition container of claim 7, wherein when the port is in the first position, the ammunition container is sealed watertight.

13. The ammunition container of claim 7 further comprising:

a small, tethered vent on the lid to disallow vacuum formation during ammunition pours.

* * * * *